United States Patent [19]

Gustafson

[11] Patent Number: 4,881,672

[45] Date of Patent: Nov. 21, 1989

[54] SAFETY ATTACHMENT PRUSE HOOK

[76] Inventor: Olivia Gustafson, 514 A St., Fairbanks, Ak. 99701

[21] Appl. No.: 189,950

[22] Filed: May 3, 1988

[51] Int. Cl.[4] ..... A41F 15/02

[52] U.S. Cl. ..... 224/264; 224/268; 224/901; 340/568; 340/571; 200/61.19

[58] Field of Search ..... 224/268, 265, 264, 901; 2/2, 74, DIG. 6, 94; 150/102, 133, 134; 340/568, 571, 574; 200/61.19

[56] References Cited

U.S. PATENT DOCUMENTS

| | | | |
|---|---|---|---|
| 4,63,169 | 11/1891 | Scott . | |
| 1,151,696 | 8/1915 | Levin | 224/264 |
| 1,801,227 | 4/1931 | Derby . | |
| 2,714,979 | 8/1955 | McCarthy | 224/264 |
| 2,783,926 | 3/1957 | Wise . | |
| 2,927,311 | 3/1960 | Donaldson | 340/571 |
| 3,083,885 | 4/1963 | Ware | 224/264 |
| 3,153,791 | 10/1964 | White | 2/2 |
| 3,940,039 | 2/1976 | Sasaki | 224/264 |
| 3,949,915 | 4/1976 | Burhans . | |
| 4,055,873 | 11/1977 | Kallman | 224/901 |
| 4,386,723 | 6/1983 | Mule | 224/264 |

FOREIGN PATENT DOCUMENTS

| | | | |
|---|---|---|---|
| 2101783 | 1/1983 | United Kingdom | 340/571 |

*Primary Examiner*—Linda J. Sholl
*Attorney, Agent, or Firm*—Jerry T. Kearns

[57] ABSTRACT

A safety attachment purse hook is provided with a hook and loop type fastening strip, of the type sold under the trademark VELCRO, for cooperation with a VELCRO fastening strip secured to a shoulder portion of a jacket or coat. The hook allows the strap of a pocketbook or purse to be retained to the shoulder of the jacket or coat. The cooperating VELCRO fastening strips provide a safety release which prevents injury to an individual if an excessive force is exerted on the purse strap. In a second embodiment, a spring biased latching mechanism is provided for retaining the purse strap securely within the hook. An alarm is included in a housing portion of the hook and is actuated upon disengagement of the cooperating VELCRO fastening strips on the hook and on the jacket.

5 Claims, 3 Drawing Sheets

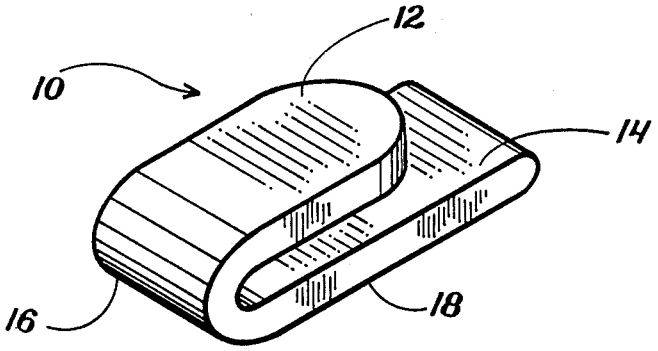
FIG 1
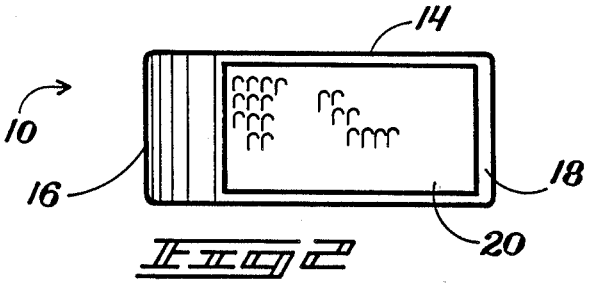
FIG 2
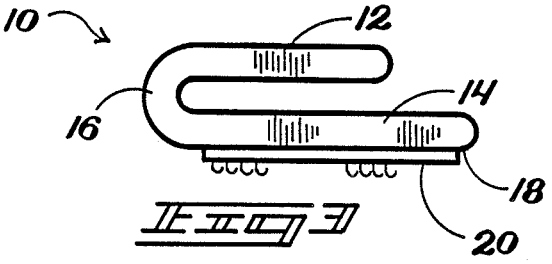
FIG 3
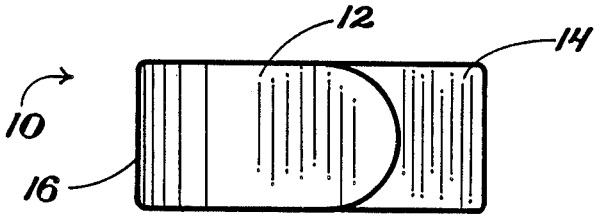
FIG 4
FIG 5
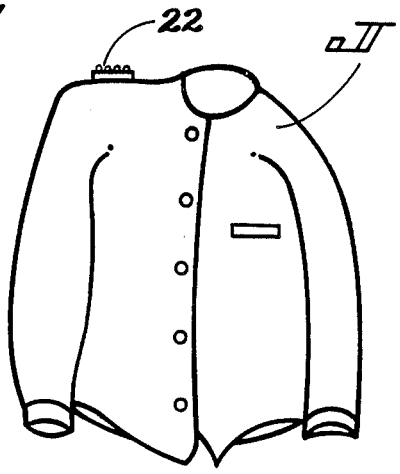

SAFETY ATTACHMENT PRUSE HOOK

BACKGROUND OF THE INVENTION

1. Field of the Invention

The present invention relates to purse safety attachment devices, and more particularly pertains to a new and improved safety attachment purse hook for retaining the shoulder strap of a purse on the shoulder of a coat or jacket of an individual. In order to enable an individual to have free use of their hands, the prior art has provided various securing devices for retaining the straps of pocketbooks and purses to articles of apparel of an individual. However, these devices create a dangerous condition in that if an excessive force is exerted on the strap of the purse or pocketbook, this excessive force will be transmitted directly to the body of the individual. This has the potential for causing serious injury and has created a serious problem. In order to overcome this problem, the present invention provides a purse safety hook which utilizes cooperating hook and loop type fastening strips, of the type sold under the trademark VELCRO, to provide a safety release if excessive force is exerted to the strap of the purse, thus preventing harm or injury to the individual. Additionally, a purse snatcher will frequently grap the purse of an individual while running at a high rate of speed. If the purse strap is rigidly secured to the individual's body, this may result in potential severe injury to the individual. In order to overcome this problem, and to provide an alarm device for the deterrent of purse snatchers, the present invention provides a VELCRO attached purse safety hook which includes an alarm which is actuated by excessive force exerted on the purse strap.

2. Description of the Prior Art

Various types of purse safety attachment devices are known in the prior art. A typical example of such a safety attachment device is to be found in U.S. Pat. No. 463,169, which issued to E. Scott on Nov. 17, 1891. This patent discloses a chain securement yoke for a purse or pocketbook which automatically closes the purse or pocketbook when suspended from the chain. U.S. Pat. No. 1,801,227, which issued to H. DeBry on Apr. 15, 1931, discloses a safety attachment for a purse for the deterrent of purse snatchers. The device includes a pair of straps adapted to be secured to the carrying strap of a purse. The attached straps are each provided with a plurality of spikes which will stick the hand of an individual attempting to snatch the purse. U.S. Pat. No. 2,783,926, which issued to G. Wise on Mar. 5, 1957, discloses a safety attachment hook for securing a purse to an article of an individual's apparel. U.S. Pat. No. 3,949,915, which issued to E. Burhans on Apr. 13, 1976, discloses an attachment hook device for securing a purse to the belt of an individual. A downwardly open hollow receptacle is provided for attachment to a portion of a person's body by means of a belt or similar support secured about the waist of the individual. The upper end of the receptacle is closed except for a small diameter opening and a short length flexible anchor member is provided which is slidably received through the small diameter opening. The end portion of the anchor member passes downwardly to the interior of the receptacle and is provided with a releasable catch assembly for releasably anchoring a selected portion of a purse.

While the above mentioned devices are suited for their intended usage, none of these devices provide a safety attachment purse hook which utilizes cooperating VELCRO fastening strips to provide a safety release mechanism to prevent injury to an individual if an excessive force is exerted on the strap of the purse. Additionally, none of the aforesaid prior art purse safety attachment devices provide a safety attachment hook which includes an alarm activated when an excessive force is exerted on the strap of the purse. Inasmuch as the art is relatively crowded with respect to these various types of purse safety attachment devices, it can be appreciated that there is a continuing need for and interest in improvements to such purse safety attachment devices, and in this respect, the present invention addresses this need and interest.

SUMMARY OF THE INVENTION

In view of the foregoing disadvantages inherent in the known types of purse safety attachment devices now present in the prior art, the present invention provides an improved safety attachment purse hook. As such, the general purpose of the present invention, which will be described subsequently in greater detail, is to provide a new and improved safety attachment purse hook which has all the advantages of the prior art purse safety attachment devices and none of the disadvantages.

To attain this, representative embodiments of the concepts of the present invention are illustrated in the drawings and make use of a safety attachment purse hook having a hook and loop type fastening strips, of the type sold under the trademark VELCRO, for cooperation with a VELCRO fastening strip secured to a shoulder portion of a jacket or coat. The hook allows the strap of a pocketbook or purse to be retained to the shoulder of the jacket or coat. The cooperating VELCRO fastening strips provide a safety release which prevents injury to an individual if an excessive force is exerted on the purse strap. In a second embodiment, a spring biased latching mechanism is provided for retaining the purse strap securely within the hook. An alarm is included in a housing portion of the hook and is actuated upon disengagement of the cooperating VELCRO fastening strips on the hook and on the jacket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety attachment purse hook which was all the advantages of the prior art purse safety attachment devices and none of the disadvantages.

It is another object of the present invention to provide a new and improved safety attachment purse hook which may be easily and efficiently manufactured and marketed.

It is a further object of the present invention to provide a new and improved safety attachment purse hook which is of a durable and reliable construction.

An even further object of the present invention is to provide a new and improved safety attachment purse hook which is susceptible of a low cost of manufacture with regard to both materials and labor, and which accordingly is then susceptible of low prices of sale to the consuming public, thereby making such purse safety attachment devices economically available to the buying public.

Still yet another object of the present invention is to provide a new and improved safety attachment purse hook which provides in the apparatuses and methods of the prior art some of the advantages thereof, while simultaneously overcoming some of the disadvantages normally associated therewith.

Still another object of the present invention is to provide a new and improved safety attachment purse hook which utilizes cooperating VELCRO fastening strips to provide a safety release to prevent injury to an individual if an excessive force is exerted on the strap of the purse.

Yet another object of the present invention is to provide a new and improved safety attachment purse hook which provides an alarm device for the deterrence of purse snatchers.

Even still another object of the present invention is to provide a new and improved safety attachment purse hook having an alarm device activated by the exertion of excess force on the strap of a purse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the safety attachment purse hook according to the first embodiment of the present invention.

FIG. 2 is a bottom view of the purse hook according to the first embodiment of the present invention.

FIG. 3 is a side view of the purse hook according to the first embodiment of the present invention.

FIG. 4 is a top view of the purse hook according to the first embodiment of the present invention.

FIG. 5 illustrates a coat or jacket provided with a cooperating VELCRO fastening strip for engagement with the safety attachment purse hook according to the first and second embodiments of the present invention.

DESCRIPTION OF THE PREFERRED EMBODIMENT

Figure 6:
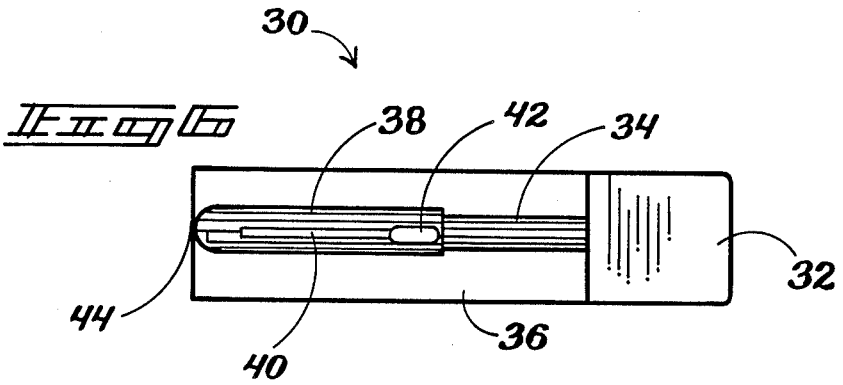
FIG. 6 is a top view of the purse hook according to the second embodiment of the present invention.

With reference now to the drawings, and in particular to FIG. 1 thereof, a new and improved safety attachment purse hook embodying the principles and concepts of the present invention and generally designated by the refence numeral 10 will be described.

More specifically, it will be noted that the first embodiment 10 of the invention includes a generally U-shaped hook formed from a generally rectangular strip of material. The hook may be formed from either a metal or a plastic material, and it is contemplated that the hook may be provided in a variety of colors for matching the color of the coat or jacket of an individual. The U-shaped hook has a first longer leg portion 14 which extends in parallel spaced relation to a shorter leg portion 12. The first 14 and second 12 leg portions are connected by an arcuate bight portion 12. The material utilized to form the hook 10 has a limited amount of resilience to allow slight flexing apart of the legs 12 and 14 upon insertion of a purse strap therebetween. This allows the strap of the purse to be maintained in a relatively secure position, by virtue of frictional engagement between the legs 12 and 14.

As shown in FIG. 2, the bottom surface 18 of the first leg porton 14 is provided with a hook fastening strip 20. The hook fastening strip, of the type sold under the trademark VELCRO, 20 may be secured by adhesives or other conventional means to the bottom surface 18 of the first leg portion 14 of the hook 10.

In FIG. 3, a side view is provided of the purse hook 10 according to the first embodiment of the present invention.

In FIG.4, a top view of the purse hook 10 is provided.

As illustrated in FIG. 5, the purse hook 10 of the present invention is adapted for cooperation with a jacket J or coat of an individual. A cooperating loop VELCRO fastening strip 22 is secured by sewing or other conventional means to a shoulder portion of the jacket J. In use, the purse hook 10 of the present invention is placed on the shoulder portion of the jacket J, with the hook VELCRO fastening strip 20 in engagement with the loop VELCRO fastening strip 22. An individual may then insert the strap of a purse between the leg portions 12 and 14 of the hook 10. The purse will then be maintained and secured in position on the shoulder of the individual, without requiring the individual to utilize either hand to hold the purse or the strap thereof. In the event that an excessive force is exerted on the strap of the purse, the cooperating VELCRO fasteners 20 and 22 will disengage, thus preventing any injury to the individual or damage to the jacket J.

With reference now to FIG. 6, a modified form of purse hook 30 according to a second embodiment of the present invention will now be described. The purse hook 30 includes a generally rectangular flat base 36 provided with an upstanding housing 32 adjacent one end thereof. A hollow tubular hook portion 38 is rigidly secured to the base 36 by a bight portion 44. A slidable latch bar 34 is received for slidable extension and retraction within the tubular hook portion 38. An upstanding projection 42 formed integrally with the latch bar 34 is received for sliding movement in a slot 40 which extends through a top wall of the tubular hook portion 38. A coil spring within the hook body portion 38 biases the latch bar 34 to the illustrated closed position. By manipulation of the projection 42, the latch bar 34 may be opened to allow a purse hook to be inserted between the hook portion 38 and the base 36.

Figure 7:
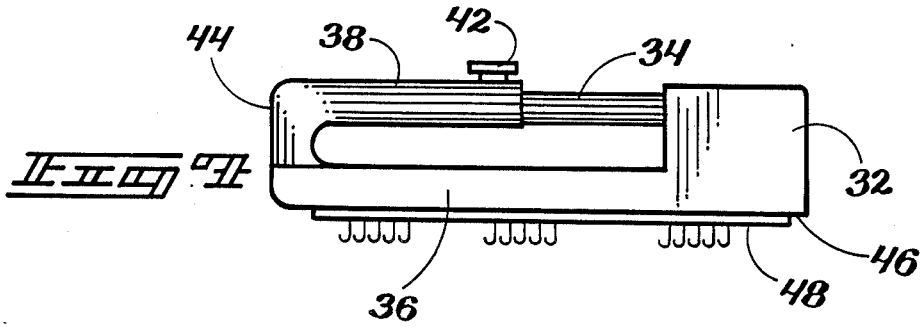
FIG. 7 is a side view of the purse hook according to the second embodiment of the present invention.

In FIG. 7, a side view of the purse hook 30 according to the second embodiment of the present invention is provided. A hook VELCRO fastening strip 48 is secured to a bottom surface 46 of the base 36. The VELCRO fastening strip 48 is adapted for engagement with the cooperating VELCRO fastening strip 22 provided on the jacket J, as illustrated in FIG. 5.

Figure 8:
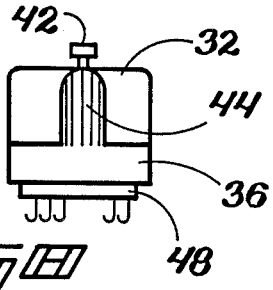
FIG. 8 is a left end view of the purse hook according to the second embodiment of the present invention illustrated in FIG. 7.

In FIG. 8, a left end view of the purse hook 40 is provided.

Figure 9:
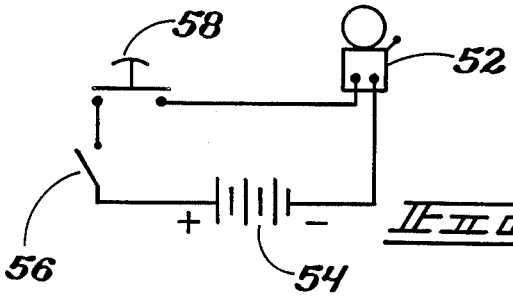
FIG. 9 is a schematic diagram of the alarm mechanism of the purse hook according to the second embodiment of the present invention.

In FIG. 9, a schematic diagram is provided of an alarm device which is enclosed within the housing 32 of the hook 30. The alarm includes an audible bell or buzzer 52 which is connected in series with a battery 54, an alarm activation switch 56 and an alarm enable/disable switch 58.

Figure 10:
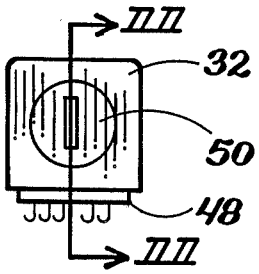
FIG. 10 is a right end view of the purse hook according to the second embodiment of the present invention, illustrated in FIG. 7.

In FIG. 10, a right end view of the purse hook 30 according to the second embodiment of the present invention is provided.

Figures 11, 12:
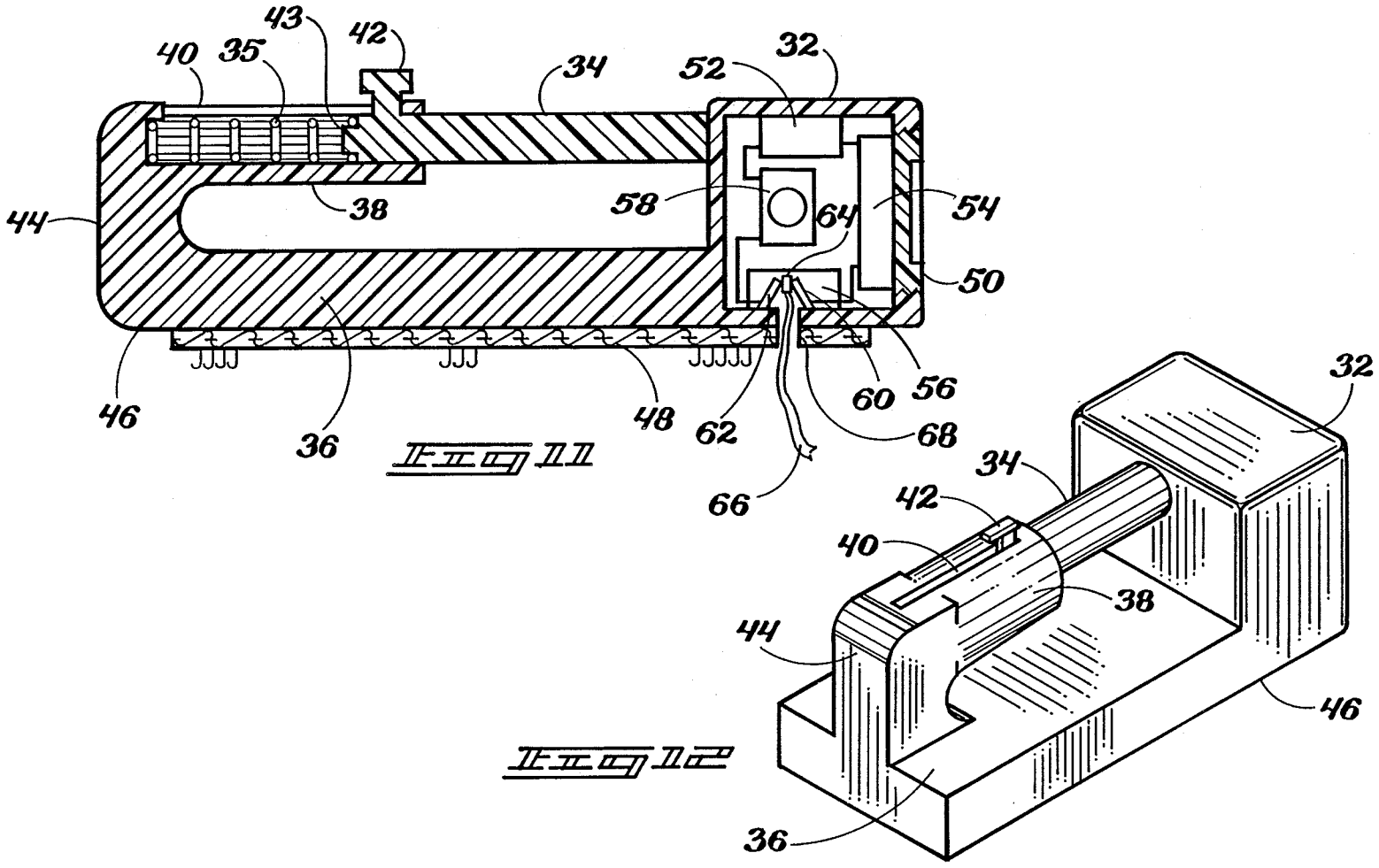
FIG. 11 is a longitudinal cross sectional view, taken along line 11—11 of FIG. 10, illustrating the internal construction of the purse hook according to the second embodiment of the present invention.
FIG. 12 is a perspective view of the purse hook according to the second embodiment of the present invention.

As shown in the longitudinal cross sectional view of FIG. 11, the housing 32 is provided with a threaded closure plug 50 for allowing access to the housing interior. A battery 54 which may be of any conventional type is connected in series with an alarm activation switch 56, a push button type alarm enable/disable switch 58 and an audible bell or buzzer 52. The alarm activation switch 56 includes a pair of metallic leaf spring type contacts 60 and 62 which are separated by an insulating bar 64. The insulating bar 64 may be formed from plastic, cardboard, rubber or a variety of other conventional insulating materials. The insulating member 64 is secured to a flexible cord or strap 66 which is adapted to be attached to some portion of the coat or jacket of the individual. The cord 66 extends through an aperture 60 formed through the housing 32 and the VELCRO securing strip 48. In use, the VELCRO fastening strip 48 is placed in engagement with the cooperating fastening strip 22 on the jacket J of the individual (FIG. 5). The end of the cord 66 is then attached to a button or secured in some other conventional fashion to the jacket J. The purse strap is then inserted between the tubular hook portion 38 and the base 36 by manipulation of the latch bar 34. In this condition, the purse will be retained in secure engagement on the shoulder of an individual, thus freeing the individual's hands for other uses. If an excessive force is exerted on the strap on the purse, for example, by a purse snatcher, the VELCRO fastening strip 48 will disengage from the VELCRO fastening strip 22 on the jacket J. The insulator 64 will then be pulled from between the leaf spring contacts 60 and 62 of the alarm activating switch 56. These contacts 60 and 62 will then close, thus activating the audible alarm 52. As may now be readily understood, the alarm enable/disable switch 58 may only be accessed by removing the plug 50 of the housing 32. This prevents a thief from quickly deactivating the alarm. When the purse and attached purse hook 30 are retrieved, it is merely necessary to insert the insulator 64 between the spring contacts 60 and 62 to reset the alarm 52. As previously mentioned, a coil spring 35 within the tubular hook portion 38 biases the latch bar 34 to the illustrated closed position. The latch bar 34 is provided with a reduced diameter projection 43 for engagement with the coil spring 35. The latch bar 34 may be formed separately from the projection 42 for assembly purposes, or the hook body 38 and the base portions 36 may be assembled from symmetric molding halves.

FIG. 12 provides a perspective view of the purse hook 30 according to the second embodiment of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety attachment purse hook for securing a purse strap to an article of apparel, comprising:

hook means for engagement with a purse strap;

cooperating hook and loop type fastening strips on said hook means and on said article of apparel for releasably securing said hook means to said article of apparel;

alarm means on said hook means for providing a signal upon attempted theft of a purse carried thereon; and means for actuating said alarm means upon disengagement of said cooperating hook and loop type fastening strips on said hook means and said article of apparel.

2. The safety attachment purse hook of claim 1, further comprising a hollow housing portion on said hook means;

an audible alarm in said housing for providing an audible signal upon attempted theft of a purse supported by said hook means;

an alarm activation switch operably connected for actuating said audible alarm upon disengagement of said cooperating hook and loop type fastening strips on said hook means and said article of apparel;

an alarm enable/disable switch operably connected for selectively enabling or disabling said audible alarm; and battery means in said housing connected in series with said alarm activation switch, said alarm enable/disable switch, and said audible alarm, for powering said audible alarm.

3. The safety attachment purse hook of claim 2, wherein said alarm activation switch comprises a pair of leaf spring contacts;

an insulating member disposed between said spring contacts;

aligned apertures formed through said hook and loop type fastening strip and said housing; and a cord secured to said insulating member for attachment to said article of apparel.

4. The safety attachment purse hook of claim 3, wherein said alarm enable/disable switch is completely enclosed within said housing.

5. The safety attachment purse hook of claim 1, wherein said hook means comprises a hook having a spring biased latch bar biased to a closed position for capturing a purse strap.

* * * * *